United States Patent [19]

Scheibel

[11] 4,297,206

[45] Oct. 27, 1981

[54] SOLVENT EXTRACTION OF SYNFUEL LIQUIDS

[75] Inventor: Edward G. Scheibel, Media, Pa.

[73] Assignee: Suntech, Inc., Philadelphia, Pa.

[21] Appl. No.: 117,591

[22] Filed: Feb. 1, 1980

[51] Int. Cl.[3] ..... C10G 45/02; C10G 67/04

[52] U.S. Cl. ..... 208/254 R; 208/8 LE; 208/11 LE; 208/57; 208/78; 208/143; 208/87; 208/88; 208/96; 208/210; 208/211; 208/236; 208/240; 208/289; 208/291; 208/311; 208/318; 208/326; 208/335

[58] Field of Search ..... 208/254 R, 254 H, 8, 208/11, 239, 311, 318, 326, 335, 236, 289, 240, 291, 298

[56] References Cited

U.S. PATENT DOCUMENTS

| | | | |
|---|---|---|---|
| 2,026,812 | 1/1936 | Birkhimer | 208/332 |
| 2,067,137 | 1/1937 | Clarke | 208/328 |
| 2,279,550 | 4/1942 | Benedict et al. | 208/57 |
| 2,287,736 | 6/1942 | Hersberger | 208/323 |
| 2,357,667 | 9/1944 | Kuhn | 208/326 |
| 2,906,693 | 9/1959 | Donaldson | 208/87 |
| 4,159,940 | 7/1979 | Smith | 208/254 R |

*Primary Examiner*—Delbert E. Gantz
*Assistant Examiner*—G. E. Schmitkons
*Attorney, Agent, or Firm*—J. Edward Hess; Donald R. Johnson; Patrick C. Baker

[57] ABSTRACT

An improvement in the solvent extraction of nonhydrocarbons from a synfuel liquid, e.g., shale oil, involves that the extract from the extractor, rather than being recycled directly back to the extractor, is first hydrotreated. A further improvement involves that a portion of the hydrotreated extract is fractionated and a light fraction is returned to the extractor. Use of the hydrotreated extract as recycle increases the efficiency of the extractor. A still further improvement involves the use as a selective solvent of one of the following: dialkylformamide, aldehydomorpholine, keto-morpholine, morpholine or an aliphatic aromatic ketone. These preferred solvents have the advantage of providing a clear interface between the extract and raffinate in the extractor. Removal of the nonhydrocarbons permits production of more hydrocarbons having enhanced utility as a jet fuel from a synfuel liquid than otherwise would be possible.

14 Claims, 2 Drawing Figures

SOLVENT EXTRACTION OF SYNFUEL LIQUIDS

BACKGROUND

Figure 1:
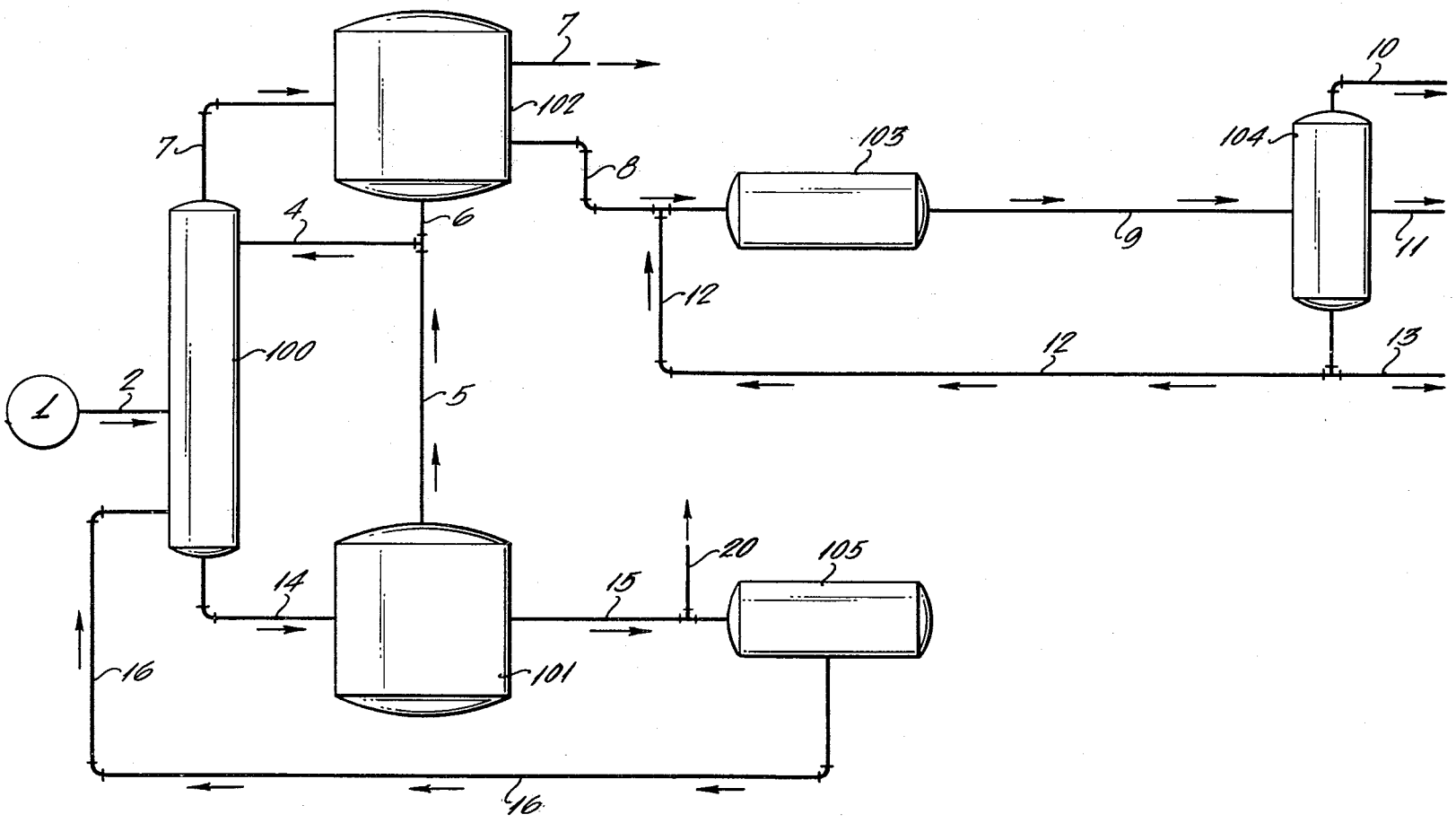

This invention was made under U.S. Contract F33615-78-C2024 with the U.S. Department of Defense.

FIELD OF THE INVENTION

This invention relates to an improvement in the solvent extraction of a synfuel liquid including shale oil and coal liquid. One aspect of the improvement in the removal of nonhydrocarbons from a synfuel liquid is that in the solvent extraction of a synfuel liquid the extract from the solvent extractor is hydrotreated prior to its return to the extractor. Another aspect is that the improvement is further enhanced when a portion of the hydrotreated extract is fractionated and an overhead fraction is returned to the extractor. Still another aspect of the improvement is the use of particular solvents to extract nonhydrocarbons, e.g., nitrogen compounds, from the synfuel. Another aspect of the improvement is maximizing the production of jet fuel from synfuels, preferably shale oil. Still another aspect is to increase the effectiveness of the solvent in the extractor. Other aspects will be apparent to those skilled in the art.

Solvent extraction generally involves separating a liquid mixture into at least two component fractions by means of a liquid-liquid extraction procedure. In this procedure the incoming mixture is extracted by a solvent which is then treated to separate the extract product from the solvent, which after separation, all or a part of it is recycled to the extraction step to insure complete removal of the hydrocarbons from this fraction. In this invention the liquid mixture is a synfuel liquid including a shale oil or a coal liquid. The synfuel liquids contain nonhydrocarbons such as nitrogen compounds, e.g., amines, and oxygenated compounds, e.g., phenols. And the solvent used has a selectivity for the nonhydrocarbons contained in a synfuel liquid.

DESCRIPTION OF THE PRIOR ART

Generally liquid-liquid extraction of a mixture with a solvent is known. However, one of the problems associated with extraction processes is one's inability to predict which solvent at what conditions will work on a particular mixture, especially if the latter comprises numerous different hydrocarbons and different nonhydrocarbons. One inventor, in connection with his U.S. Pat. No. 3,415,743, describes the problem thus: "The choice of the particular solvent may be the difference between success and failure in finding the optimum conditions."

One class of solvents which applicant has found to be surprisingly effective in removing certain nonhydrocarbons, particularly certain nitrogen compounds, from a synfuel liquid is an alkylformamide which has the following structure:

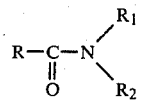

wherein R and $R_1$ are selected from the group consisting of hydrogen and alkyl and $R_2$ is an alkyl, each of the alkyls containing from one to ten carbon atoms. And no suggestion of the aforementioned is given in U.S. Pat.

Nos. 2,957,811 and 3,788,980, which disclose the use of amides such as dimethylformamide for the extraction of an aromatic hydrocarbon from a mixed hydrocarbon feed. Also, U.S. Pat. No. 3,415,743 discloses using a solution of dimethylformamide and water as a solvent for the extraction of heavy aromatics and heavy aliphatics from cycle oil derived from a petroleum cracking step. Other U.S. patents which disclose the use of alkylformamides as a primary of auxiliary solvent to extract aromatics from a mixed hydrocarbon feed include U.S. Pat. Nos. 2,067,137, 2,183,852, 3,546,108, 2,850,547 and 2,935,470. The latter two patents disclose mineral oils, coal tar oils and shale oils as possible feeds. U.S. Pat. No. 2,906,693 discloses a method in which dimethyl formamide is used to extract metalliferous impurities from gas oils normally charged to a catalytic cracking operation.

Another class of solvents, which applicant has found to be surprisingly effective in removing nonhydrocarbons, particularly certain nitrogen compounds, from synfuel liquid, is an aliphatic-aromatic ketone. No suggestion of this is given in U.S. Pat. No. 2,026,812 which discloses using an aliphatic-aromatic ketone, including acetophenone, to generally separate a crude petroleum or a petroleum product into a fraction of different chemical composition and in particular to separate paraffinic and naphthenic hydrocarbons from an oil containing both.

Another class of solvents, which applicant has found to be surprisingly effective in removing nonhydrocarbons, particularly nitrogen compounds from a synfuel liquid, are morpholine, aldehydro-morpholines, and keto-morpholines. While U.S. Pat. No. 2,357,667 discloses the use of such morpholines as an extraction solvent for a hydrocarbon oil to separate the oil into fractions which are respectively rich in relatively unsaturated and relatively saturated constituents, the Patent is silent as to any suggestion of the use found effective by applicant. U.S. Pat. Nos. 2,287,736; 3,679,579; 3,816,302 and 4,001,107 also disclose the use of various morpholines and their mixtures as selective solvents for aromatic hydrocarbons.

All the previous proposed uses for these particular solvents are based on the extraction of aromatic and unsaturated compounds from saturated paraffins. However, in this invention, the solvent is used to remove non-hydrocarbons from all hydrocarbons including aromatic and unsaturated compounds.

Removal of nitrogen compounds, using magnesium silicate, from shale oil is disclosed in U.S. Pat. No. 2,606,143. U.S. Pat. No. 2,741,578 discloses using organic hydroxy compound, e.g., ethylene glycol, to extract nitrogen compounds from a shale oil or a mineral oil obtained from the coking of soft coal. Selective extraction of basic materials, including nitrogen compounds, from shale oil or coal tar oil via the use of a mixture of sulfur dioxide and water is suggested in U.S. Pat. No. 2,754,248. Another U.S. Pat. No. 2,662,843 discloses the use of formic acid to remove nitrogen compounds from shale oil; it also discloses that the acid will remove oxygen compounds. The use of synthetic or natural siliceous mineral having base exchange properties converted into the acid or hydrogen ion condition, to denitrogenate a shale oil or a coal tar oil is disclosed in U.S. Pat. No. 2,943,049. Another U.S. Pat. No. 2,925,381, discloses the use of a solid metallo alumino silicate having substantially uniform pores of at least 7A. in diameter to remove nitrogen compounds from a shale oil or a coal tar oil which is produced in the coking of coal. The same patent also discloses the use of catalytic hydrogenation to lower the amount of nitrogen compounds in hydrocarbons; it also indicates the use of Fuller's earth. U.S. Pat. Nos. 2,925,380 and 2,925,379 disclose processes similar to the last aforementioned patent. U.S. Pat. No. 2,518,353 discloses the use of acid ammonium or amino, or salts of strong nonvolatile acids in an aqueous solution as an extraction solvent for removing nitrogen compounds from shale oil or coal tar. It also mentions the use of diluted strong mineral acids such as sulfuric acid; the use of relatively strong organic acids; the use of extraction solvents including aniline, furfural, isopropyl alcohol and nitrobenzene.

U.S. Pat. No. 3,717,571 discloses the use of a two stage hydrogenation reaction system to lower the nitrogen content of a coal liquid or a raw shale oil. U.S. Pat. No. 4,133,745 discloses fractionating a raw shale oil into (1) a naphtha cut which is hydrotreated; (2) a gas oil cut which is first treated with caustic to remove arsenic and similar materials and then hydrotreated. The object of the aforementioned processing is to remove both nitrogen compounds and arsenic and similar materials. U.S. Pat. No. 4,159,940 discloses mixing a syncrude with a mineral acid and then after settling, mildly hydrotreating the low nitrogen oil phase, whereas the acid oil phase is neutralized with a base and the resulting high nitrogen oil is subjected to severe hydrotreatment.

U.S. Pat. No. 2,279,550 suggests solvent extracting a coal tar or a shale oil and then hydrotreating the extract which is subsequently catalytically cracked.

However, none of the foregoing patents disclose or suggest hydrotreating all or part of the extracted product from a solvent extraction process before returning it to the extractor. Still further, none disclose or suggest that a further improvement can be obtained by fractionating the hydrotreated extract and returning an overhead fraction to the extractor.

SUMMARY OF THE INVENTION

An improvement in the removal of nonhydrocarbons from a synfuel liquid is obtained by hydrotreating all or part of the extract from a synfuel liquid solvent extractor. Normally the extract would be returned to the extractor after its separation from the solvent without any further processing. The improvement is further enhanced when all or a portion of the hydrotreated extract is fractionated and at least one fraction, generally an overhead fraction, is returned to the extractor.

The improvement is still further enhanced by the use of a solvent selected from the group consisting of dialkylformamide, e.g., N,N'-dimethylformamide, aldehydomorpholine, keto-morpholine, morpholine, and aliphatic-aromatic ketone, e.g., acetophenone. The removal of the nonhydrocarbons from the synfuel enhances its eventual use as a fuel, e.g., a jet fuel. Further the selective removal of certain nitrogen compounds, i.e., the lower boiling amines (in contrast to higher boiling amines) permits separation of the higher boiling amines from hydrocarbons by distillation so that a nitrogen free jet fuel fraction may be recovered directly by distillation of the raffinate. Finally, the foregoing solvents were found to have a unique property of dissolving foreign compounds, e.g., asphaltenes, asphaltene precursors or metallic complexes, that separate out of the solution in the presence of other solvents such as aqueous dioxane, acetic acid, methanol, and ethanolamine, thereby providing a cleaner interface in the extraction column.

DRAWING

The accompanying Figures are diagrammatic flow schemes of two embodiments of applicant's improvement. The process represented therein has as its emphasis the production of jet fuel from a shale oil containing nonhydrocarbons. However, the emphasis is not intended as a limitation but rather one particular illustration of applicant's method.

DESCRIPTION

For an understanding of applicant's invention, reference is made to the accompanying FIG. 1. Shale oil (or coal liquid), 1, containing nonhydrocarbons, including nitrogen and oxygen compounds, is fed, via conduit 2, to extractor 100. The shale oil can be a crude or partially hydrogenated shale oil (generally boiling from about 170° C. to about 500° C.) or certain fractions thereof. The shale oil feed can be heated by various means (not shown) to reduce its viscosity. Also fed to the extractor 100 is recycle solvent via conduit 4. "Crude" as used herein refers to shale oil which has not had any prior treatment after being obtained from shale. Coal liquid refers to a crude liquid (or a fraction thereof) obtained from coal by various conversion processes, e.g., hydroliquefaction. The latter generally involves contacting coal particles with a hydrocarbon solvent (optional) at an elevated temperature and pressure and in the presence of hydrogen and often in the presence of a catalyst.

In extractor 100 the shale oil contacts solvent which is recycled from extract fractionator 101 via conduits 4 and 5 and from raffinate fractionator 102 via conduits 6 and 4. The extractor 100 is designed to provide the proper degree of contact, suitable residence time for phase disengagement between mixing zones and sufficient mixing zones or stages to give the desired degree of separation of the components in the shale oil. In the extractor 100 the solvent removes the readily extractable lower boiling nitrogen compounds, particularly the low boiling amines, and oxygenated compounds. Also in the extractor 100 two product phases are obtained, a raffinate and an extract. The solvents which can be used are generally low boiling, for ease of separation of the extract and solvent, and have suitable solvency for the nonhydrocarbons and non-solvency for the hydrocarbons. Examples of suitable solvents include lower molecular weight glycols, furfural, formic acid and others described hereinafter.

The raffinate, which contains the higher boiling nitrogen compounds, e.g., amines, leaves the extractor 100 via conduit 7 and can pass through heat exchange means (not shown) and is fed to raffinate fractionator 102. In the latter the raffinate is stripped of the dissolved solvent which is recycled to extractor 100 via conduits 6 and 4. Because of difference in boiling points the fraction suitable for jet fuel can be easily separated from the higher boiling nitrogen compounds. The raffinate leaves the fractionator 102 via conduit 7 and is a high quality precursor for jet fuel or may be a jet fuel depending on the quality of feed to extractor 100. The higher boiling amine residue from the fractionator 102 leaves via conduit 8 and can be fed to a hydrotreater 103. In hydrotreater 103 the hydrogen treatment will be sufficiently severe to eliminate nitrogen as ammonia, which would be removed along with light hydrocarbons, e.g., methane. The removal of such materials is not shown. Usable operating conditions for the hydrotreater depend in part on the particular feed and desired products but generally are known to those skilled in the art or can be determined without undue experimentation. The hydrogen treated product from the hydrotreater 103 can be fed, via conduit 9, to a distillation unit 104 where a light naphtha is taken overhead via conduit 10 while additional jet fuel is removed via conduit 11. The heavy bottoms from distillation unit 104 can be separated so that a portion is recycled to the hydrotreater 103 via conduit 12 while the other portion 13 is a purge which can be further treated, e.g., via hydrocracking (not shown), or used for hydrogen generation (not shown).

The extract leaves the extractor 100 via conduit 14 and can pass through heat exchange means (not shown) and is fed to the extract fractionator 101. In the latter the solvent is stripped from the extract and recycled via conduits 5 and 4 back to the extractor 100. The extract product, the lower boiling nitrogen compounds, e.g., amines, is fed via conduit 15, to a hydrotreater 105. Operating conditions for the hydrotreater depend in part on the particular feed and desired products but generally are known to those skilled in the art or can be determined without undue experimentation. A purge of extract can be taken off via conduit 20. The purge can be sent to the hydrotreater 103 or used to product hydrogen by partial oxidation. It is possible that if the hydrotreater 105 is operated at more severe conditions a purge of extract will not be necessary. However, in hydrotreater 105 the extract receives a mild, relative to the treatment given the residue from the unit 102, hydrogen treatment and is recycled back via conduit 16 to the extractor 100. Any light hydrocarbons and other gases produced in hydrotreater 105 can be removed; such removal is not shown. However, because it is a mild treatment, production of such materials is minimized.

The mild hydrogen treatment of the extract represents applicant's improvement and provides the following advantage compared to no hydrogenation of the recycled extract. The effectiveness of the recycled extract is increased because the density of the returning extract has been decreased by the hydrogenation. The lighter material, particularly that portion which is raffinate material, will travel up the column increasing the overall efficiency of the extractor 100. Also the amount of raffinate obtained will be increased.

Figure 2:
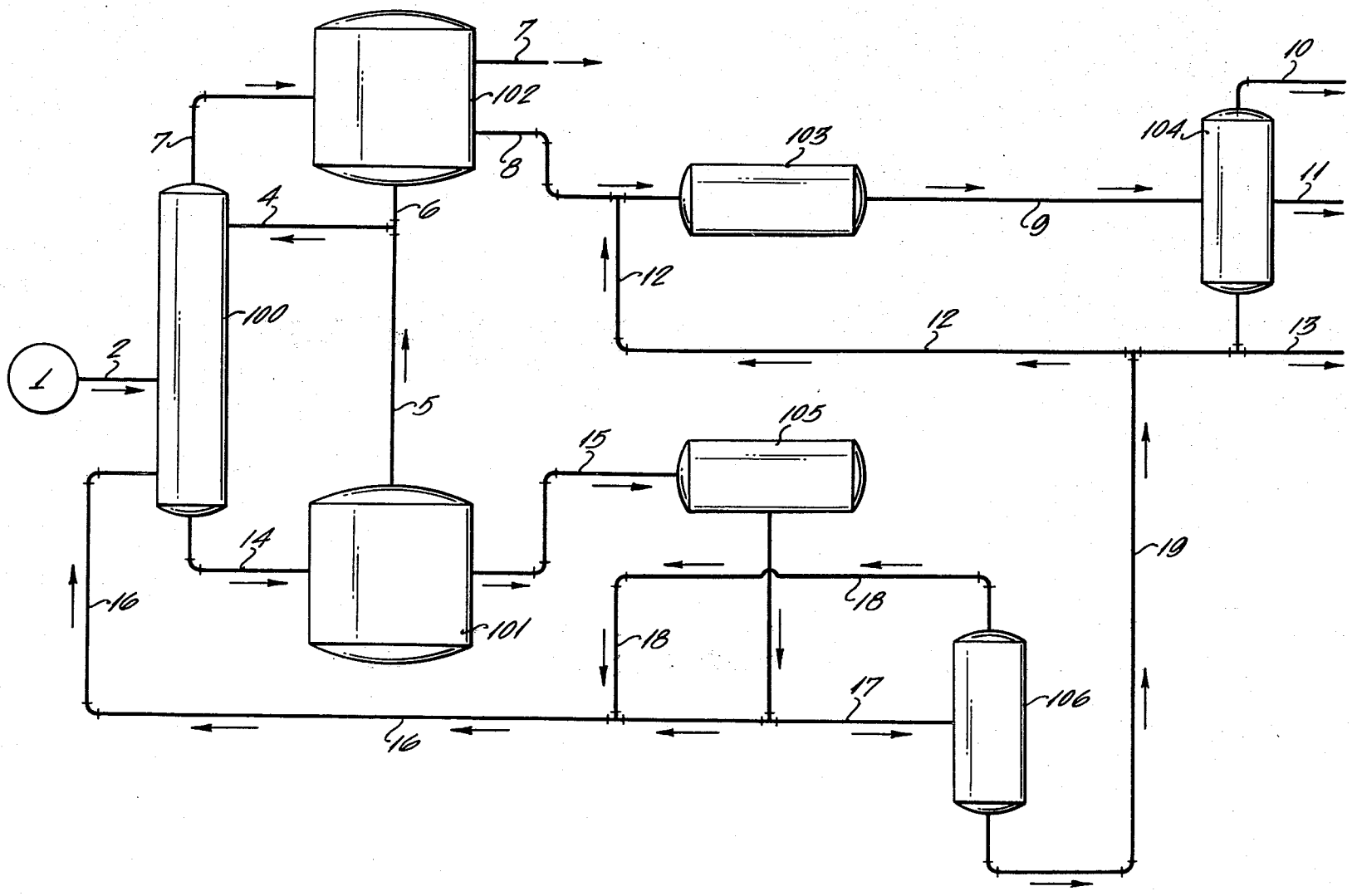

FIG. 2 is another embodiment of the process and is almost the same as shown in FIG. 1 except for the following. In FIG. 2 some of the hydrogen treated extract is fed to, via conduit 17, to a distillation unit 106 from which a light overhead friction is fed via conduit 18 back to the extractor 100. More than one overhead fraction may be obtained. The reason for use of distillation unit 106 is that some of the amines may not be hydrogenated and their accumulation is controlled by the purge to the distillation unit 106. The bottoms from the distillation unit 106 is fed via conduit 19 to the heavy fraction recycle stream going to the hydrotreater 103 via conduit 12. While no purge of the feed to hydrotreater 105 is shown in FIG. II, some may occur. However, because of the inclusion of distillation unit 106, such a purge is not a preferred method.

Another advantage of the applicant's improvement is that two hydrotreaters are used. The use of two hydrotreaters enables the use of more optimal operating conditions on each of two different feedstocks thereby reducing the production of the amount of lighter hydrocarbons such as methane, ethane and the like and light naphthas. Reduction in the production of the amount of lighter hydrocarbons can increase the amount of hydrocarbons boiling within the jet fuel range.

As mentioned previously solvents having an affinity for nonhydrocarbons can be used. However some solvents are preferred because of a surprising property, that of producing a sharp interface. The preferred solvents used herein have the unique property of dissolving foreign compounds which separate from a synfuel liquid upon contacting with many solvents normally used for the extraction of petroleum mixtures into aromatics and other hydrocarbons. The foreign compounds are difficult to identify because of their complex structures and can include metallic complexes, asphaltenes and other materials. Examples of the unsatisfactory solvents from the standpoint of a sharp interface include acetic acid, methanol and ethanolamines. With any of the unsatisfactory solvents the interface in the extractor 100 between the extract and raffinate would not be sharp or clear, but rather hazy, thereby making a clean separation difficult and contributing to inefficient performance of the extraction equipment. In contrast applicant's solvents have the important advantage of providing a sharp, clean interface in the extractor 100.

One class of preferred solvents useful for the solvent extraction of a synfuel liquid by applicant's method are the dialkylformamides. More preferred dialkylformamides are the N,N'-dialkylformamides and still more preferred examples include dipropylformamide, methylpropylformamide, diethylformamide, propylethylformamide and dimethylformamide which is greatly preferred.

Another class of preferred solvents useful for the solvent extraction of a synfuel liquid, is aldehydo-morpholine, keto-morpholine, and morpholine. The aldehydo-morpholines and keto-morpholines can be represented by the following empirical formula:

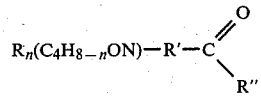

wherein R is an alkyl group; n may have a value ranging from 0 up to about 8; R' may be either absent or else represent a bivalent hydrocarbon radical; and R'' represents either hydrogen or a hydrocarbon. When R'' represents hydrogen the compound is an aldehydo-morpholine, whereas when R'' represents a hydrocarbon group the compound is a keto-morpholine. Morpholine is more preferred and has the following chemical structure:

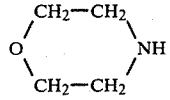

Another class of preferred compounds useful for solvent extraction of a synfuel liquid, is an aliphatic-aromatic ketone. One example of the latter is acetophenone, which has the following structure,

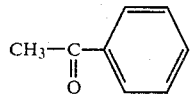

and is more preferred.

All of the aforementioned preferred solvents can be used by adding an amount of water to make them immiscible with the synfuel liquid. With crude shale oil the amount of water used would be about 5–15 volume % while for a coal liquid the amount used would be higher, e.g., about 10–30 volume %. Shale oil is the preferred feed stock for the preferred solvent.

In general, liquid-liquid extraction can be conducted at temperatures between the freezing point of the materials and their boiling points. However, commercial operations are more typically conducted at temperatures between about 0° C. and about 200° C., the temperature depending in part on the pressure. Also influencing the temperature is the particular synfuel liquid, the particular solvent, the solvent feed ratio, the number of extraction stages, the degree of extraction which is sought, etc., as will be apparent to one skilled in the art. Generally the extraction temperature should be sufficiently high to reduce the viscosity of the shale oil so a reasonable efficiency can be obtained in the extraction equipment.

The extraction ratio of solvent to a synfuel liquid feed stock must be sufficient to exceed its solubility under the extraction conditions in the feed stock in order to form two distinct liquid phases. The phases are a raffinate phase containing a relatively small amount of dissolved solvent and an immiscible extract phase comprising most of the solvent and extract. Generally employed are between about 0.5 and about 4 volumes of solvent (including any water) per volume of synfuel liquid feed with about 1 to about 2 volumes of solvent per volume of feed stock preferred. Sufficient pressure is maintained within the extractor 100 to prevent substantial volatilization of the synfuel liquid feed or solvent under the liquid-liquid extraction conditions. As is known, pressure and temperatures are related variables in the extraction process and generally those which are suitable for extraction are used. Usually pressures within the range of about 15 to about 100 p.s.i. are sufficient. However, a specific pressure and temperature for a particular feed and solvent can be determined without undue experimentation.

Further, in contrast to prior art extraction processes, applicant's extractor is not run at operating conditions favoring extraction of aromatics. For example, the amount of reflux of extractor 100 is controlled by returning aromatics to the extractor.

The present invention can be carried out in batch, continuous or semi-continuous operating cycles, and in one or more actual or theoretical stages, employing contacting and separation equipment known to those skilled in the art. Various types of liquid-liquid extraction operations and suitable extraction equipment are described in various texts, e.g., Perry's Chemical Engineering Handbook, 1973 Edition, Library of Congress Card 73-7866.

To further illustrate the invention, the following example and comparison are provided.

EXAMPLE

The elemental analysis of crude Paraho shale oil used in this example is shown in the Table, Column 1. For comparative purposes a sample of the Paraho shale oil was treated with KOH and the resulting raffinate had the elemental analysis shown in Column 2.

Comparison of the elemental analyses of the Columns 1 and 2 indicates that generally the KOH did little to change the composition of the treated Paraho shale oil.

Illustrating applicant's invention is the elemental analysis of the raffinate obtained via a DMF (abbreviation for N,N'-dimethylformamide) extraction. Comparison of the analysis of Columns 1, 2 and 3 indicates that the DMF favored the extraction of the oxygen containing compounds and the total nitrogen material. It also reduced the sulfur somewhat.

The KOH treatment consisted of using 15% aqueous KOH with an equal amount of the shale oil at room temperature and shaking for about a half hour. Then the mixture was allowed to settle and the upper layer (the oil) was decanted. The yield of KOH raffinate was about 87%.

The DMF treatment consists of counter currently extracting the shale oil with DMF and separating about half of the dissolved shale oil components from the extract for the reflux to the extraction system. The extraction unit consisted of eight stages; the shale oil was added to the third stage; the DMF was added to the eighth stage. In the first stage a portion of the shale oil was separated from the extract by the addition of about 10 vol.% water and the separated oil was passed counter currently through the extraction system to the DMF. The temperature (~40° C.) was just high enough to keep the waxy solids in solution in the raffinate. The volume ratio of DMF to shale oil was about 1.5 to 1. The yield of the raffinate was about 85 wt.%.

TABLE

Solvent Extraction Removes Non-Hydrocarbons

| Analysis, wt.% | (1) Whole Crude | (2) Raffinate from KOH Treatment | (3) Raffinate from DMF Treatment |
|---|---|---|---|
| C | 84.26 | 84.95 | 84.98 |
| H | 11.31 | 11.48 | 12.44 |
| O | 1.37 | 1.33 | 0.88 |
| $N_T$ | 1.889 | 1.766 | 1.345 |
| $N_B$ | 1.30 | 1.4 | — |
| S | 0.70 | 0.77 | 0.58 |
| H/C | 1.61 | 1.62 | 1.76 |

An advantage of the DMF treatment was that the interface between the extract and raffinate was clear and sharp. This made for clean separations between the two layers. In contrast the interface between the extract and raffinate, when acetic acid, methanol or ethanolamines were used, was hazy which made it difficult to obtain a clean separation.

The other dialkylformamides such as dipropylformamide, methylpropylformamide, diethylformamide, propylethylformamide will yield analogous results. Equally analogous results will be obtained when using an aldehydo-morpholine, or a keto-morpholine, or an aliphatic-aromatic ketone.

While a crude shale oil was used in the example, similar results will be obtained when using shale oil fractions. Also use of a crude coal liquid or fraction thereof in place of the crude shale oil will also yield similar results.

I claim:

1. In the process of separating nonhydrocarbons from synfuel liquid by extraction using an extractor wherein a selective solvent contacts the synfuel liquid, a solvent-extract mixture is separated from a raffinate, the mixture is separated into the solvent and an extract, and the extract is returned to the extractor, the improvement which comprises hydrotreating all or a portion of the extract prior to return to the extractor, whereby nitrogen in the extract is eliminated as ammonia and the production of jet fuel is maximized.

2. Process according to claim 1 wherein all or a portion of the hydrotreated extract is charged to a distillation unit from which a fraction is obtained and is returned to the extractor.

3. Process according to claim 1 or 2 wherein the selective solvent is selected from the group consisting of dialkylformamide, aldehydo-morpholine, keto-morpholine, morpholine and aliphatic aromatic ketone.

4. Process according to claim 1 or 2 wherein the synfuel liquid is selected from the group consisting of shale oil and coal liquid.

5. A process to maximize jet fuel production from a synfuel liquid comprising:

(a) feeding a synfuel liquid to an extractor wherein a solvent extracts the lower boiling point nitrogen compounds and resulting solvent-extract mixture is separated from a raffinate which contains the higher boiling nitrogen compounds;

(b) feeding the raffinate to a first fractionator wherein a fraction suitable for jet fuel is separated from the higher boiling nitrogen compounds, said nitrogen compounds then being fed to a first hydrotreater operating at conditions such that nitrogen in the higher boiling compounds is reacted to form ammonia; and (c) feeding the solvent-extract mixture from step (a) to a second fractionator wherein the solvent is separated from the extract containing the lower boiling point nitrogen compounds for return to the first fractionator, and feeding all or a portion of the resulting extract to a second hydrotreater operating at conditions such that nitrogen in the lower boiling compounds is reacted to form ammonia.

6. Process according to claim 5 wherein resulting product from hydrotreating the raffinate in step (b) is distilled into at least a jet fuel fraction and a residue.

7. Process according to claim 5 wherein resulting product from hydrotreating the extract in step (c) is recycled back to the extractor.

8. Process according to claim 7 wherein a portion of the product resulting from hydrotreating the extract is distilled into at least a residue which is fed to the first hydrotreater treating the higher boiling nitrogen compounds.

9. Process according to claim 5, 6, 7 or 8 wherein the synfuel liquid is selected from the group consisting of shale oil and coal liquid.

10. In the process of separating nonhydrocarbons from a synfuel liquid by extraction using a selective solvent, the improvement which comprises using as the selective solvent a solvent selected from the group consisting of dialkylformamide, aldehydo-morpholine, keto-morpholine, morpholine, and aliphatic aromatic ketone.

11. Process according to claim 10 wherein the dialkylformamide is N,N'-dimethylformamide.

12. Process according to claim 10 wherein the aliphatic aromatic ketone is acetophenone.

13. Process according to claim 10 wherein the solvent is morpholine.

14. Process according to claim 10, 11, 12 or 13 wherein the synfuel liquid is selected from the group consisting of shale oil and coal liquid.

* * * * *